United States Patent [19]

Herron

[11] Patent Number: 4,822,304

[45] Date of Patent: Apr. 18, 1989

[54] EMI SHIELDED ELECTRICAL CONNECTOR AND CABLE ASSEMBLY

[75] Inventor: Robert C. Herron, Austin, Tex.

[73] Assignee: Minnesota Mining and Manufacturing Company, St. Paul, Minn.

[21] Appl. No.: 100,747

[22] Filed: Sep. 24, 1987

[51] Int. Cl.[4] ..... H01R 13/648

[52] U.S. Cl. ..... 439/610; 439/904

[58] Field of Search ..... 439/607-610

[56] References Cited

U.S. PATENT DOCUMENTS

| | | | |
|---|---|---|---|
| 3,744,128 | 7/1973 | Fisher et al. | 439/610 |
| 3,977,755 | 8/1976 | Edel et al. | 439/610 |
| 4,457,576 | 7/1984 | Cosmos et al. | 439/610 |
| 4,497,533 | 2/1985 | Genova et al. | 439/610 |
| 4,508,414 | 4/1985 | Kusui et al. | 439/610 |
| 4,514,029 | 4/1985 | Lax et al. | 439/610 |
| 4,592,612 | 6/1986 | Kikuta | 439/610 |
| 4,662,700 | 5/1987 | Markham | 439/607 |

OTHER PUBLICATIONS

Electrical Products Division/3M. New Product Bulletin "3535 Drain Wire Spring Clip."

Scotchflex-Instructions for the Assembly of 3357 Delta EMI/ESD Junction Shell.

New Product Bulletin-3M EMI/ESD Shield Junction Shell for Delta Sub Connectors.

Electrical Products Division/3M. Product Data-Scotch 24 Electrical Shielding Tape.

*Primary Examiner*—David Pirlot

*Attorney, Agent, or Firm*—Donald M. Sell; Walter N. Kirn; John C. Barnes

[57] ABSTRACT

An EMI/ESD shielded D cable-connector assembly wherein the shielding between the cable shield and metal shell of the connector is afforded by a length of wire mesh surrounding the conductors and joining said shield to said shell. A shielding plate contacting said mesh and positioned for contact to the mating D connector assures a continuous ground.

6 Claims, 2 Drawing Sheets

EMI SHIELDED ELECTRICAL CONNECTOR AND CABLE ASSEMBLY

BACKGROUND OF THE INVENTION

1. Field of the Invention

The present invention relates to an improved cable connector assembly including a cable with multiple conductors and a connector and in one aspect to an improved shielding for electromagnetic interference/electrostatic discharge (EMI/ESD) around the conductors extending from the cable shielding to the connector.

2. Description of the Prior Art

The prior art is replete with D subminiature connector assemblies and most such assemblies have provided the interface between the cable and the connector shroud with some shielding effectiveness to try to meet the EMI/RFI standards. All such prior art devices have been formed in a manner which makes them time consuming to manufacture to reliably provide the effective shielding or the casing surrounding the interface is bulky. One assembly of the prior art is a structure wherein a premolded form is built around the connector wires and then the shielding is provided by a copper tape which is wrapped about the premolded conductors. The copper tape is then soldered around the entire periphery of the connector shroud adjacent a peripheral mounting flange for the connector, the tape is soldered at its ends, and is soldered the full 360' around the cable shield to provide a low resistance ground path. The outer jacket is then molded over the tape and remaining assembly.

Such assembly operations to provide the effective shielding and ground path is time consuming. The steps in making such a shielded terminal are extensive.

The present invention provides a connector assembly wherein the shielding between the cable shield and the connector is formed by a very compliant conductive wire mesh which is wrapped about the conductors with one edge of the length of mesh contacting the periphery of the connector shroud on one side of the mounting flange and the other edge of the mesh is contacting the cable shield and is maintained in contact therewith by a spring biased connection affording spring reserve contact. A covering is then preferably formed by molding over the mesh between the connector flange of the metal shell of the connector and the cable sheath. The porous wire removes the need to premold around the conductors.

The low resistance ground path is further enhanced by the use of a shield plate which is secured along a plate-like portion thereof to the mesh and which is stamped such that the other end covers the mounting flange and extends along the metal shell or shroud of the D connector and slides into the slot between the connector's metal shell and plastic body supporting the contacts to readily contact the mating connector metal shroud.

The advantages of the present invention are thus seen in that the mesh can be readily wrapped around the terminal ends of the conductors and can be formed to cover the conductors between the exposed end of the cable shield and the conductor with the cable extending either out an end or side from the connector or straight away from the connector.

The structure of the present invention provides an aesthetic covering with effective shielding. The structure of the present invention does not have a heavy bulky metal termination.

SUMMARY OF THE INVENTION

The present invention is directed to an EMI/ESD shielded connector and cable assembly. The cable comprises a plurality of conductors, a shield and an outer insulating sheath. The connector comprises individual contacts connected to the ends of said conductors and the connector has a metal shell or shroud surrounding the insulative body. The shroud has a peripheral mounting flange generally used for securing the connector to a mating connector. A length of conductive wire mesh is wrapped about the exposed conductors which extend from an exposed end of the shield in the cable to the contacts of the connector. The mesh contacts the metal shell of the connector and the cable shield which extends from the cable sheath. A shield plate is joined to the wire mesh and extends over a portion of the mounting flange and extends along the metal shell of the connector having a hooked end which slides between the metal shell and the connector. A covering is provided to cover the connector and conductors between the mounting flange of the connector shroud and the insulating sheath of the cable. Such a structure may be used with discrete wire cable or flat cable or flat cable which is folded to fit in a circular shield of a cable.

In a preferred form means are provided for maintaining a constant force to assure electrical contact between one edge of the wire mesh and the cable shield.

BRIEF DESCRIPTION OF THE DRAWING

The present invention will be further described with reference to the accompanying drawing wherein.

DETAILED DESCRIPTION

Figure 1:
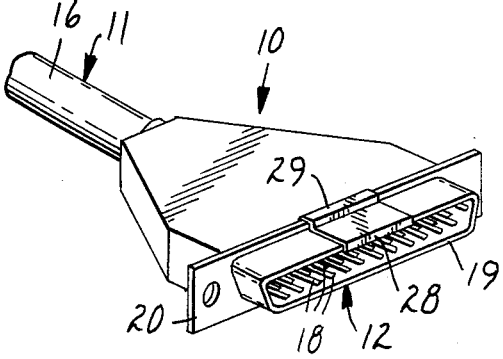
FIG. 1 is a perspective view of a cable connector assembly.

Referring now to the drawing, the overmolded shielded shell for a connector and cable assembly will be described. The connector and cable assembly of the present invention comprises a EMI/E$D shielded connector and cable assembly 10 comprising a cable 11 and a connector 12 with a molded cover 14 about the connection between the conductors 15 of the cable 11 and the connector 12.

Figure 2:
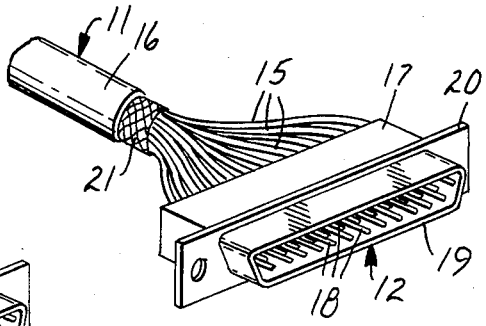
FIG. 2 is a detail perspective view of the cable end and conductors connected to a connector.

The molded cover 14 is applied after the shielding is provided about the conductors which shielding wraps the conductors and extends from the shielding of the cable to the metal shroud 19 of the electrical connector. As shown in FIG. 2, the conductors 15 of the cable are connected to individual contacts of a D miniature electrical connector 12. The connector comprises an insulative body 17 having metal contacts to afford connection to the conductors 15 and female or male, as illustrated at 18, elements to mate with a second connector. A metal shell or shroud 19 having a peripheral mounting flange 20 encloses the insulative connector body 17. In this position the conductors 15 are fanned from the shielded round sheathed cable and the metal shield 21 has been stripped from the conductors 15 to permit them to fan to the contact elements of the connector 12. The metal shield 21 which is woven on the conductors serves not only as an electrical shield and ground but also as an armor covering to protect the conductors. The outer sheath 16 of insulative material is stripped more than the shield 21 to expose the shield.

Figure 5:
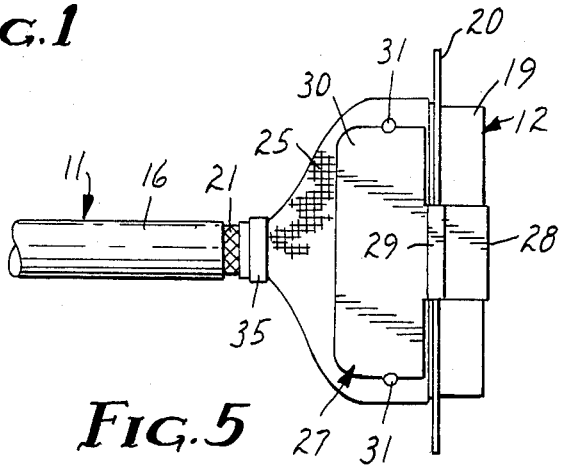
FIG. 5 is a plan view of a connector prior to the application of the overmolded shell.

A length of flexible conductive mesh 25 is wrapped about the conductors and has sufficient length and width that the ends of the mesh will overlap on one major side of the connector and the mesh has a width such that it can be gathered along one edge about the shield 21 of the cable and the other edge contacts the peripheral edge of the metal shell 19 adjacent the flange 20 as illustrated in FIG. 5.

The mesh 25 is preferably electrical shielding tape such as Scotch Brand 24 electrical shielding tape sold by Minnesota Mining and Manufacturing Company of St. Paul, Minn. The wire mesh is formed of tinned copper wire, woven in a sleeve and flattened with a mesh size sufficiently small to provide effective shielding and thus of a size of about 1 mm in any dimension of the opening. The wire size makes the tape moldable or readily conformable about the conductors. The mesh size allows air and molten plastic material to pass through during the overmolding.

A shield plate 27 is conductively connected to the mesh 25 adjacent each side of the connector. The shield plate 27 is provided at one end with a hook member 28 that fits along the projecting edge of the connector shroud and is molded with an offset 29 to contact the peripheral flange 20 of the connector and is joined to a flat blade 30 which is positioned along the periphery of the connector over the mesh 25. Two spots of solder 31 are positioned along edges of the blade to bond the same to the mesh or are positioned at other positions between the blade 30 and mesh 25 to make good electrical connections.

Figure 6:
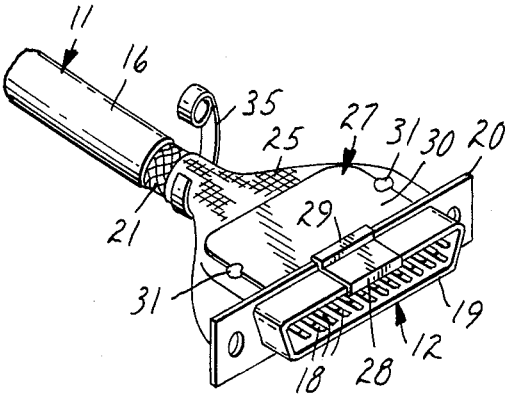
FIG. 6 is a perspective detail view of the cable shield conductors and spring connector for the mesh and cable shield.
Figure 3:
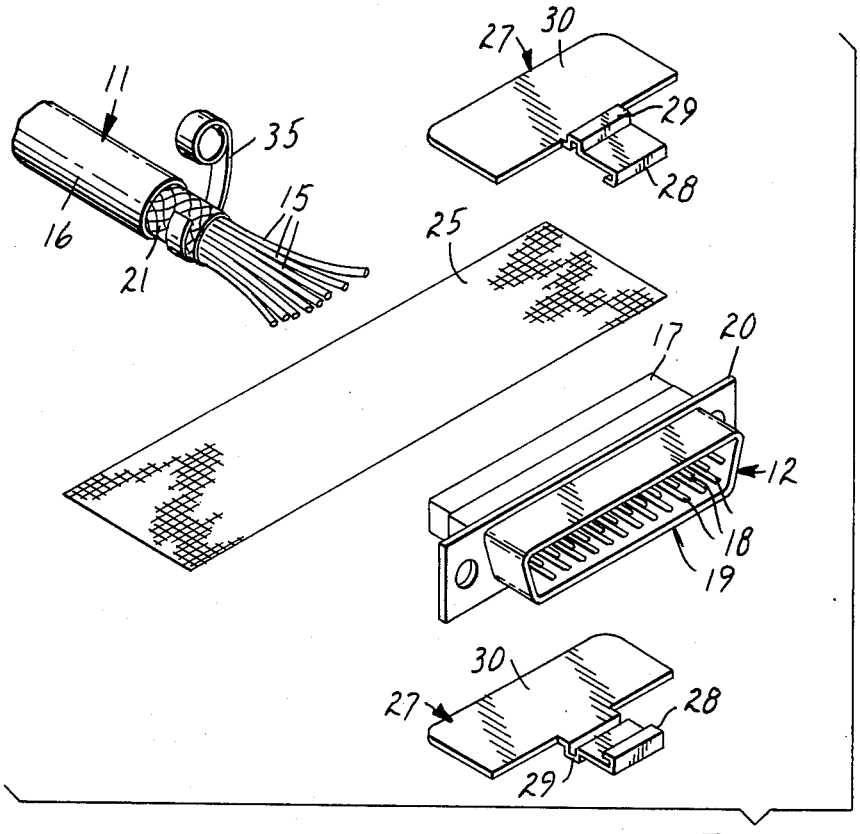
FIG. 3 is an exploded perspective view of the cable and connector components prior to overmolding.
Figure 4:
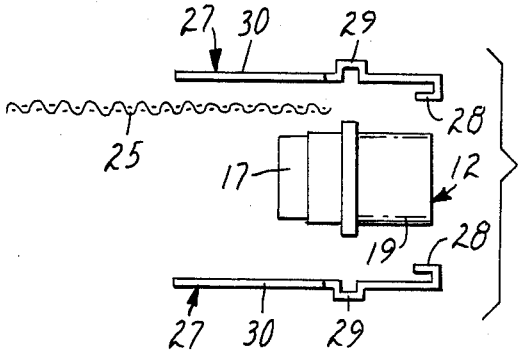
FIG. 4 is an exploded side elevational view.

A spring clip 35 is used to maintain electrical contact between the opposite edge of the wire mesh 25 and the shield 21 of the cable 11 as shown in FIGS. 3 and 6. This spring clip 35 comprises a strip of stainless steel having a thickness of preferably 0.06 mm (0.0025 inch) and a width of 6.35 mm (0.25 inch) and a length of approximately 11.4 cm (4.5 inches), which has a normal convolutely wound position with an interior diameter of about 4.5 mm (0.18 inch). This spring clip 35 is readily wrapped around the mesh urging the same into electrical contact with the shield 21 of the cable 11. This spring clip 35 will maintain that contact through changes in temperature to which the cable may become subjected because of the spring reserve in the clip 35 as the cable shield has a normal outside diameter of about 7.9 mm (0.3 inch). The spring is convolutely wound to apply pressure radially inward.

The connector and cable assembly formed as in FIG. 5 is ready for insertion into a two-part mold, and upon closing the mold about the end of the sheath 16 on the cable and the marginal edge of the connector, a plastic material is injected into the mold to form the cover 14.

Figure 7:
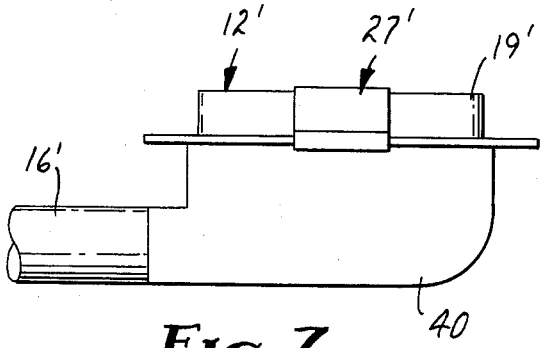
FIG. 7 is a plan view of a D connector with the cable directed out the side.

The flexible shielding tape 25 permits the cable to be positioned at about any angle to the connector. As illustrated in FIG. 7, the cable 36 extends endwise away from a molded cover 40 which is formed over conductors connected to a connector within a shroud 19′ and over a plate portion of a shield plate 27′.

The hook members 28 of the metal shields 27 can be formed with flexible fingers, as is common in the art, to improve electrical contact and RF shielding between the shield 27 and the connector 12 and the mating connector.

The present invention thus provides good EMI/ESD shielding and continuous ground between the shield of the cable on one connector and the shield of the cable of the next or mating connector by contact between the shield plates of one connector element with the metal shell of the mating connector.

Various modifications and changes may be made in the actual structure of the invention without departing from the spirit and scope of the invention as defined in the appended claims wherein:

I claim:

1. An EMI/ESD shielded connector and cable assembly comprising
   - a length of cable comprising a plurality of conductors, a shield and outer insulating sheath,
   - a connector comprising individual contacts connected to said conductors and having a conductive metal shroud having a peripheral flange,
   - said conductors extending from said sheath and said shield extending from said insulating sheath,
   - a length of conductive wire mesh wrapped about said conductors and contacting said shroud along one edge and the other edge being wrapped about said exposed shield,
   - a shield plate having a plate portion conductively coupled to said mesh and being formed to cover a portion of said flange and extend along said connector, and
   - a cover extending over said mesh from said cable sheath to said connector flange.

2. An assembly according to claim 1 wherein said mesh is connected to said shield.

3. An assembly according to claim 2 wherein said mesh is connected to said shield by a spring urging said mesh into contact with said shield.

4. An assembly according to claim 3 wherein said spring is a convolutely wound steel spring.

5. An assembly according to claim 1 wherein said mesh comprises conformable wires and a hole size sufficiently small to afford effective shielding.

6. An assembly according to claim 5 wherein said hole size is about 1 mm in any dimension of the hole.

* * * * *